US010204561B2

(12) United States Patent
Chen

(10) Patent No.: US 10,204,561 B2
(45) Date of Patent: Feb. 12, 2019

(54) AMOLED PIXEL DRIVING CIRCUIT AND PIXEL DRIVING METHOD

(71) Applicant: Shenzhen China Star Optoelectronics Semiconductor Display Technology Co., Ltd., Shenzhen (CN)

(72) Inventor: Xiaolong Chen, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 15/568,805

(22) PCT Filed: Sep. 11, 2017

(86) PCT No.: PCT/CN2017/101161

§ 371 (c)(1),
(2) Date: Oct. 24, 2017

(65) Prior Publication Data

US 2019/0012963 A1 Jan. 10, 2019

(30) Foreign Application Priority Data

Jul. 6, 2017 (CN) ..... 2017 1 0546473

(51) Int. Cl.
*G09G 3/3258* (2016.01)

(52) U.S. Cl.
CPC ... *G09G 3/3258* (2013.01); *G09G 2300/0819* (2013.01); *G09G 2310/08* (2013.01); *G09G 2320/0233* (2013.01); *G09G 2320/045* (2013.01)

(58) Field of Classification Search
CPC ..... G09G 2320/045; G09G 2310/08; G09G 3/3258
See application file for complete search history.

(56) References Cited

U.S. PATENT DOCUMENTS

2004/0207614 A1* 10/2004 Yamashita ..... G09G 3/2014 345/211
2004/0252085 A1* 12/2004 Miyagawa ..... G09G 3/3233 345/76
2005/0017934 A1* 1/2005 Chung ..... G09G 3/3233 345/82
2008/0297676 A1* 12/2008 Kimura ..... G02F 1/13624 349/39

* cited by examiner

*Primary Examiner* — Shaheda Abdin

(57) ABSTRACT

An AMOLED pixel driving circuit and pixel driving method are provided. In the pixel driving circuit, a drain of the fourth thin film transistor is electrically coupled to a terminal of the second capacitor, a drain of the third thin film transistor, and a source of the first thin film transistor; a gate of the third thin film transistor receives a second scan signal, and a source of the third thin film transistor receives a data voltage.

16 Claims, 5 Drawing Sheets

AMOLED PIXEL DRIVING CIRCUIT AND PIXEL DRIVING METHOD

RELATED APPLICATIONS

This application is a National Phase of PCT Patent Application No. PCT/CN2017/101161 having International filing date of Sep. 11, 2017, which claims the benefit of priority of Chinese Patent Application No. 201710546473.5 filed on Jul. 6, 2017. The contents of the above applications are all incorporated by reference as if fully set forth herein in their entirety.

FIELD AND BACKGROUND OF THE INVENTION

The present disclosure relates to a technical field of displays, and more particularly to an AMOLED pixel driving circuit and pixel driving method.

Organic light emitting diode (OLED) display devices have advantages of being self-luminous, having a low driving voltage, high luminous efficiency, short response time, high sharpness and contrast, a nearly 180° view angle, and a wide operating temperature range, and allowing implementation of flexible displays and large area full color displays, etc., and have become display devices with the most development potential.

Conventional active-matrix organic light-emitting diode (AMOLED) pixel driving circuits usually have a 2T1C structure, i.e., a structure of two thin film transistors plus a capacitor, which converts voltage into current.

As illustrated in FIG. 1, an existing AMOLED pixel driving circuit with a 2T1C structure includes a first thin film transistor T10, a second thin film transistor T20, a capacitor C10, and an organic light emitting diode D10. The first thin film transistor T10 is a driving thin film transistor. The second thin film transistor T20 is a switch thin film transistor. The capacitor C10 is a storage capacitor. Specifically, a gate of the second thin film transistor T20 receives a scan signal Gate, a source of the second thin film transistor T20 receives a data signal Data, and a drain of the second thin film transistor T20 is electrically coupled to a gate of the first thin film transistor T10. A source of the first thin film transistor T10 receives a positive power supply voltage OVDD, a drain of the first thin film transistor T10 is electrically coupled to an anode of the organic light emitting diode D10, and a cathode of the organic light emitting diode D10 receives a negative power supply voltage OVSS. A terminal of the capacitor C10 is electrically coupled to the gate of the first thin film transistor T10, and another terminal of the capacitor C10 is electrically coupled to the source of the first thin film transistor T10. When the 2T1C pixel driving circuit is driving the AMOLED, a current flowing through the organic light emitting diode D10 satisfies $$I=k\times(Vgs-Vth)^2,$$

where I is the current flowing through the organic light emitting diode D10, k is an intrinsic conductivity factor of the driving thin film transistor, Vgs is a voltage difference between the gate of the first thin film transistor T10 and a source of the first thin film transistor T10, Vth is a threshold voltage of the first thin film transistor T10. It can be seen that the current flowing through the organic light emitting diode D10 is related to the threshold voltage of the driving thin film transistor.

Due to reasons, such as an unstable manufacturing process, a threshold voltage of a driving thin film transistor of each pixel driving circuit in a panel is different. Even if a same data voltage is applied to the driving thin film transistor of each pixel driving circuit, the current flowing through an organic light emitting diode of each pixel driving circuit still may not be the same, thereby affecting uniformity of image displaying quality. Furthermore, as driving time of a driving thin film transistor becomes longer, aging and variation of material of the driving thin film transistor may appear, causing a threshold voltage of the driving thin film transistor to drift. Further, a degree of aging of material of each driving thin film transistor may be different, and a drift amount of a threshold voltage of each driving thin film transistor may also be different, causing the panel to display non-uniformly. Also, aging and variation of the material of the driving thin film transistor may cause a turn on voltage of the driving thin film transistor to increase, and a current flowing through an organic light emitting diode to decrease, resulting in problems such as decreased luminance and lowered luminous efficiency of the panel.

Therefore, it is desired to provide an AMOLED pixel driving circuit and pixel driving method to solve the problems existing in the prior art.

SUMMARY OF THE INVENTION

An object of the present disclosure is to provide an active-matrix organic light-emitting diode (AMOLED) pixel driving circuit and pixel driving method to increase displaying uniformity of a panel, and luminance and luminous efficiency of the panel.

In order to solve the aforementioned problems, the present disclosure provides an AMOLED pixel driving circuit that includes a first thin film transistor, a second thin film transistor, a third thin film transistor, a fourth thin film transistor, a fifth thin film transistor, a sixth thin film transistor, a first capacitor, a second capacitor, and an organic light emitting diode.

An anode of the organic light emitting diode receives a positive power supply voltage. The anode of the organic light emitting diode is electrically coupled to a source of the fifth thin film transistor, and a cathode of the organic light emitting diode is electrically coupled to a drain of the fifth thin film transistor and a source of the fourth thin film transistor. A gate of the fifth thin film transistor receives a first scan signal.

A gate of the fourth thin film transistor receives a third scan signal. A drain of the fourth thin film transistor is electrically coupled to a terminal of the second capacitor, a drain of the third thin film transistor, and a source of the first thin film transistor.

A gate of the third thin film transistor receives a second scan signal, and a source of the third thin film transistor receives a data voltage.

Another terminal of the second capacitor is electrically coupled to a terminal of the first capacitor, and another terminal of the first capacitor is coupled to a ground.

A gate of the first thin film transistor is electrically coupled to a node between the second capacitor and the first capacitor, and a drain of the first thin film transistor is electrically coupled to a source of the second thin film transistor and a drain of the sixth thin film transistor.

A gate of the second thin film transistor receives the first scan signal, and a drain of the second thin film transistor is electrically coupled to the node between the second capacitor and the first capacitor.

A gate of the sixth thin film transistor receives the third scan signal, and a source of the sixth thin film transistor receives a negative power supply voltage.

The first thin film transistor is a driving thin film transistor, and the fifth thin film transistor is a switch thin film transistor. The first thin film transistor, the second thin film transistor, the third thin film transistor, the fourth thin film transistor, the fifth thin film transistor, and the sixth thin film transistor are all P-type thin film transistors.

In the AMOLED pixel driving circuit of the present disclosure, the first thin film transistor, the second thin film transistor, the third thin film transistor, the fourth thin film transistor, the fifth thin film transistor, and the sixth thin film transistor are all low-temperature polysilicon thin film transistors, oxide semiconductor thin film transistors, or amorphous silicon thin film transistors.

In the AMOLED pixel driving circuit of the present disclosure, the first scan signal, the second scan signal, and the third scan signal are all generated by an external timing controller.

In the AMOLED pixel driving circuit of the present disclosure, the first scan signal, the second scan signal, and the third scan signal are combined, and have timing sequences corresponding to an initialization stage, a threshold voltage storing stage, and a light emitting and displaying stage.

During the initialization stage, the first scan signal and the third scan signal are both at a low voltage level, and the second scan signal is at a high voltage level.

During the threshold voltage storing stage, the first scan signal and the second scan signal are both at the low voltage level, and the third scan signal is at the high voltage level.

During the light emitting and displaying stage, the first scan signal and the second scan signal are both at the high voltage level, and the third scan signal is at the low voltage level.

In order to solve the aforementioned problems, the present disclosure provides an AMOLED pixel driving circuit that includes a first thin film transistor, a second thin film transistor, a third thin film transistor, a fourth thin film transistor, a fifth thin film transistor, a sixth thin film transistor, a first capacitor, a second capacitor, and an organic light emitting diode.

An anode of the organic light emitting diode receives a positive power supply voltage. The anode of the organic light emitting diode is electrically coupled to a source of the fifth thin film transistor, and a cathode of the organic light emitting diode is electrically coupled to a drain of the fifth thin film transistor and a source of the fourth thin film transistor. A gate of the fifth thin film transistor receives a first scan signal.

A gate of the fourth thin film transistor receives a third scan signal. A drain of the fourth thin film transistor is electrically coupled to a terminal of the second capacitor, a drain of the third thin film transistor, and a source of the first thin film transistor.

A gate of the third thin film transistor receives a second scan signal, and a source of the third thin film transistor receives a data voltage.

Another terminal of the second capacitor is electrically coupled to a terminal of the first capacitor, and another terminal of the first capacitor is coupled to a ground.

A gate of the first thin film transistor is electrically coupled to a node between the second capacitor and the first capacitor, and a drain of the first thin film transistor is electrically coupled to a source of the second thin film transistor and a drain of the sixth thin film transistor.

A gate of the second thin film transistor receives the first scan signal, and a drain of the second thin film transistor is electrically coupled to the node between the second capacitor and the first capacitor.

A gate of the sixth thin film transistor receives the third scan signal, and a source of the sixth thin film transistor receives a negative power supply voltage.

In the AMOLED pixel driving circuit of the present disclosure, the first thin film transistor, the second thin film transistor, the third thin film transistor, the fourth thin film transistor, the fifth thin film transistor, and the sixth thin film transistor are all low-temperature polysilicon thin film transistors, oxide semiconductor thin film transistors, or amorphous silicon thin film transistors.

In the AMOLED pixel driving circuit of the present disclosure, the first scan signal, the second scan signal, and the third scan signal are all generated by an external timing controller.

In the AMOLED pixel driving circuit of the present disclosure, the first thin film transistor, the second thin film transistor, the third thin film transistor, the fourth thin film transistor, the fifth thin film transistor, and the sixth thin film transistor are all P-type thin film transistors.

In the AMOLED pixel driving circuit of the present disclosure, the first scan signal, the second scan signal, and the third scan signal are combined, and have timing sequences corresponding to an initialization stage, a threshold voltage storing stage, and a light emitting and displaying stage.

During the initialization stage, the first scan signal and the third scan signal are both at a low voltage level, and the second scan signal is at a high voltage level.

During the threshold voltage storing stage, the first scan signal and the second scan signal are both at the low voltage level, and the third scan signal is at the high voltage level.

During the light emitting and displaying stage, the first scan signal and the second scan signal are both at the high voltage level, and the third scan signal is at the low voltage level.

In the AMOLED pixel driving circuit of the present disclosure, the first thin film transistor is a driving thin film transistor, and the fifth thin film transistor is a switch thin film transistor.

The present disclosure further provides an AMOLED pixel driving method including the following operations:

providing an AMOLED pixel driving circuit;

entering an initialization stage;

entering a threshold voltage storing stage; and entering a light emitting and displaying stage.

The AMOLED pixel driving circuit includes a first thin film transistor, a second thin film transistor, a third thin film transistor, a fourth thin film transistor, a fifth thin film transistor, a sixth thin film transistor, a first capacitor, a second capacitor, and an organic light emitting diode.

An anode of the organic light emitting diode receives a positive power supply voltage. The anode of the organic light emitting diode is electrically coupled to a source of the fifth thin film transistor, and a cathode of the organic light emitting diode is electrically coupled to a drain of the fifth thin film transistor and a source of the fourth thin film transistor. A gate of the fifth thin film transistor receives a first scan signal.

A gate of the fourth thin film transistor receives a third scan signal. A drain of the fourth thin film transistor is electrically coupled to a terminal of the second capacitor, a drain of the third thin film transistor, and a source of the first thin film transistor.

A gate of the third thin film transistor receives a second scan signal, and a source of the third thin film transistor receives a data voltage.

Another terminal of the second capacitor is electrically coupled to a terminal of the first capacitor, and another terminal of the first capacitor is coupled to a ground.

A gate of the first thin film transistor is electrically coupled to a node between the second capacitor and the first capacitor, and a drain of the first thin film transistor is electrically coupled to a source of the second thin film transistor and a drain of the sixth thin film transistor.

A gate of the second thin film transistor receives the first scan signal, and a drain of the second thin film transistor is electrically coupled to the node between the second capacitor and the first capacitor.

A gate of the sixth thin film transistor receives the third scan signal, and a source of the sixth thin film transistor receives a negative power supply voltage.

During the initialization stage, the first scan signal provides a low voltage level, and the second thin film transistor and the fifth thin film transistor are turned on. The second scan signal provides a high voltage level, and the third thin film transistor is turned off. The third scan signal provides the low voltage level, and fourth thin film transistor and the sixth thin film transistor are turned on. A voltage at the source of the first thin film transistor is equal to the positive power supply voltage, and a voltage at the gate of the first thin film transistor is equal to the negative power supply voltage.

During the threshold voltage storing stage, the first scan signal provides the low voltage level, and the second thin film transistor and the fifth thin film transistor are turned on. The second scan signal provides the low voltage level, and the third thin film transistor is turned on; the third scan signal provides the high voltage level, and the fourth thin film transistor and the sixth thin film transistor are turned off. A voltage at the source of the first thin film transistor is equal to the data voltage, a voltage at the gate of the first thin film transistor is transitioned into Vdata−Vth, wherein Vdata is the data voltage, and Vth is a threshold voltage of the first thin film transistor.

During the light emitting and displaying stage, the first scan signal provides the high voltage level, and the second thin film transistor and the fifth thin film transistor are turned off. The second scan signal provides the high voltage level, and the third thin film transistor is turned off. The third scan signal provides the low voltage level, and the fourth thin film transistor and the sixth thin film transistor are turned on. The organic light emitting diode emits light, and a current flowing through the organic light emitting diode is not related to the threshold voltage of the first thin film transistor.

In the AMOLED pixel driving method of the present disclosure, during the light emitting and displaying stage, a voltage at the source of the first thin film transistor is transitioned into a configured voltage, wherein the configured voltage is a difference value between the positive power supply voltage and a voltage of the organic light emitting diode, and a voltage at the gate of the first thin film transistor is transitioned into Vdata−Vth+δV, so that the current flowing through the organic light emitting diode is not related to the threshold voltage of the first thin film transistor, wherein δV is an effect on the voltage at the gate of the first thin film transistor. The effect is caused by the voltage at the source of the first thin film transistor after the voltage at the source the first thin film transistor is transitioned from the data voltage into the configured voltage.

In the AMOLED pixel driving method of the present disclosure, the first thin film transistor, the second thin film transistor, the third thin film transistor, the fourth thin film transistor, the fifth thin film transistor, and the sixth thin film transistor are all low-temperature polysilicon thin film transistors, oxide semiconductor thin film transistors, or amorphous silicon thin film transistors.

In the AMOLED pixel driving method of the present disclosure, the first scan signal, the second scan signal, and the third scan signal are all generated by an external timing controller.

In the AMOLED pixel driving method of the present disclosure, the first thin film transistor is a driving thin film transistor, and the fifth thin film transistor is a switch thin film transistor.

In the AMOLED pixel driving method of the present disclosure, the first thin film transistor, the second thin film transistor, the third thin film transistor, the fourth thin film transistor, the fifth thin film transistor, and the sixth thin film transistor are all P-type thin film transistors.

The AMOLED pixel driving circuit and pixel driving method improve existing pixel driving circuits in a way that eliminates the effect of the threshold voltage of the driving thin film transistor on the organic light emitting diode, thereby increasing displaying uniformity of a panel, and in addition avoiding problems such as decreased luminance and lowered luminous efficiency with aging of OLED devices of the panel.

DESCRIPTION OF SPECIFIC EMBODIMENTS OF THE INVENTION

Figure 1:
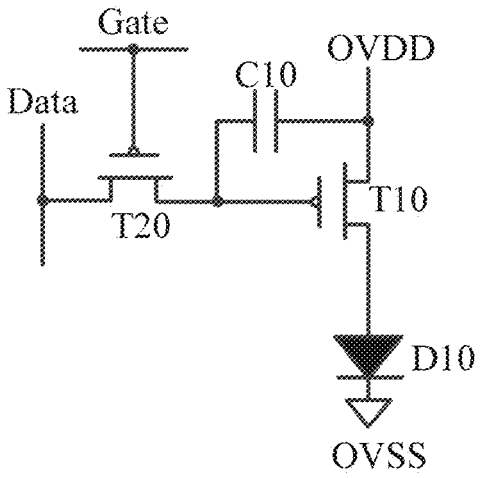
FIG. 1 PRIOR ART
FIG. 1 is a circuit diagram of an existing 2T1C pixel driving circuit for an active-matrix organic light-emitting diode (AMOLED).

The description of each embodiment below refers to respective accompanying drawing(s), so as to illustrate exemplarily specific embodiments of the present disclosure that may be practiced. Directional terms mentioned in the present disclosure, such as "upper", "lower", "front", "back", "left", "right", "inner", "outer", "side", etc., are only directions by referring to the accompanying drawings, and thus the used directional terms are used to describe and understand the present disclosure, but the present disclosure is not limited thereto. In the drawings, structurally similar units are labeled by the same reference numerals.

Figure 2:
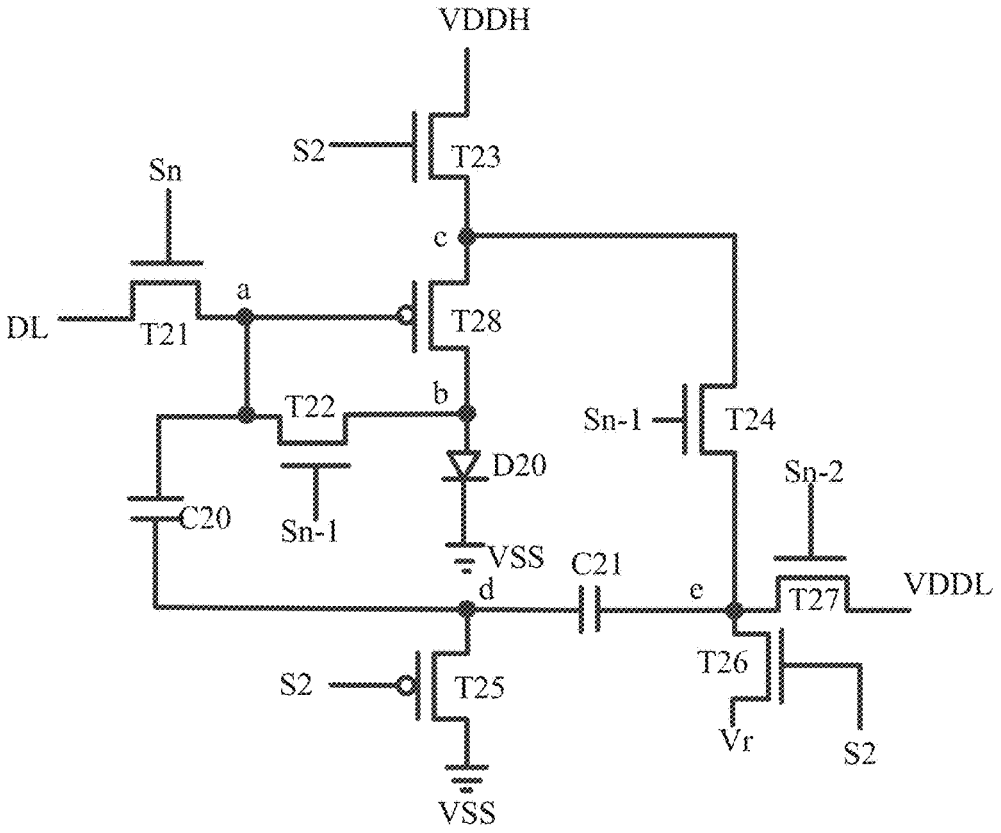
FIG. 2 is a circuit diagram of an existing 8T2C pixel driving circuit for an AMOLED.

With respect to drifting problems for threshold voltages of driving thin film transistors, the prior art usually increases numbers of thin film transistors and corresponding control signals of active-matrix organic light-emitting diode (AMOLED) pixel driving circuits, to compensate the threshold voltages of the driving thin film transistors. Therefore, while an organic light emitting diode emits light, a current flowing through the organic light emitting diode is not related to the threshold voltage of the driving thin film transistor. Referring to FIG. 2, an existing AMOLED pixel driving circuit that uses a 8T2C structure, i.e., a structure of eight thin film transistors plus two capacitors, includes a first thin film transistor T21, a second thin film transistor T22, a third thin film transistor T23, a fourth thin film transistor T24, a fifth thin film transistor T25, a sixth thin film transistor T26, a seventh thin film transistor T27, an eighth thin film transistor T28, a first capacitor C20, a second capacitor C21, and an organic light emitting diode D20. Specifically, a connection manner of each of the elements is as follows. A gate of the first thin film transistor T21 receives a scan signal Sn, a source of the first thin film transistor T21 receives a data signal DL, and a drain of the first thin film transistor T21 is electrically coupled to a first node a. A gate of the second thin film transistor T22 receives a scan signal Sn-1, a source of the second thin film transistor T22 is electrically coupled to the first node a and a terminal of the first capacitor C20, and a drain of the second thin film transistor T22 is electrically coupled to a second node b. An anode of the organic light emitting diode D20 is electrically coupled to the second node b, and a cathode of the organic light emitting diode D20 receives a common ground voltage VSS.

A gate of the third thin film transistor T23 receives a scan signal S2, a source of the third thin film transistor T23 is electrically coupled to a high power supply voltage VDDH, and a drain of the third thin film transistor T23 is electrically coupled to a third node c. A gate of the eighth thin film transistor T28 is electrically coupled to the first node a, a source of the eighth thin film transistor T28 is electrically coupled to the third node c, and a drain of the eighth thin film transistor T28 is electrically coupled to the second node b. A gate of the fourth thin film transistor T24 receives the scan signal Sn-1, a source of the fourth thin film transistor T24 is electrically coupled to the third node c, and a drain of the fourth thin film transistor T24 is electrically coupled to a fifth node e.

Another terminal of the first capacitor C20 is electrically coupled to a fourth node d. A gate of the fifth thin film transistor T25 receives the scan signal S2, a source of the fifth thin film transistor T25 is electrically coupled to the fourth node d, and a drain of the fifth thin film transistor T25 receives the common ground voltage VSS.

A terminal of the second capacitor C21 is coupled to the fourth node d, and another terminal of the second capacitor C21 is electrically coupled to the fifth node e.

A gate of the sixth thin film transistor T26 receives the scan signal S2, a source of the sixth thin film transistor T26 receives a light emitting luminance adjusting voltage Vr, and a drain of the sixth thin film transistor T26 is electrically coupled to the fifth node e. A gate of the seventh thin film transistor T27 receives a scan signal Sn-2, a source of the seventh thin film transistor T27 receives a low power supply voltage VDDL, and a drain of the seventh thin film transistor T27 is electrically coupled to the fifth node e.

Although the foregoing 8T2C structure may eliminate Vth of a driving TFT, a number of TFTs used is higher, which would lower an aperture ratio of a panel, resulting in lowered displaying luminance. Moreover, the higher number of TFTs also causes problems such as parasitic capacitance. On the other hand, the structure needs an additional power supply Vr, resulting in a more complicated hardware structure.

Figure 3:
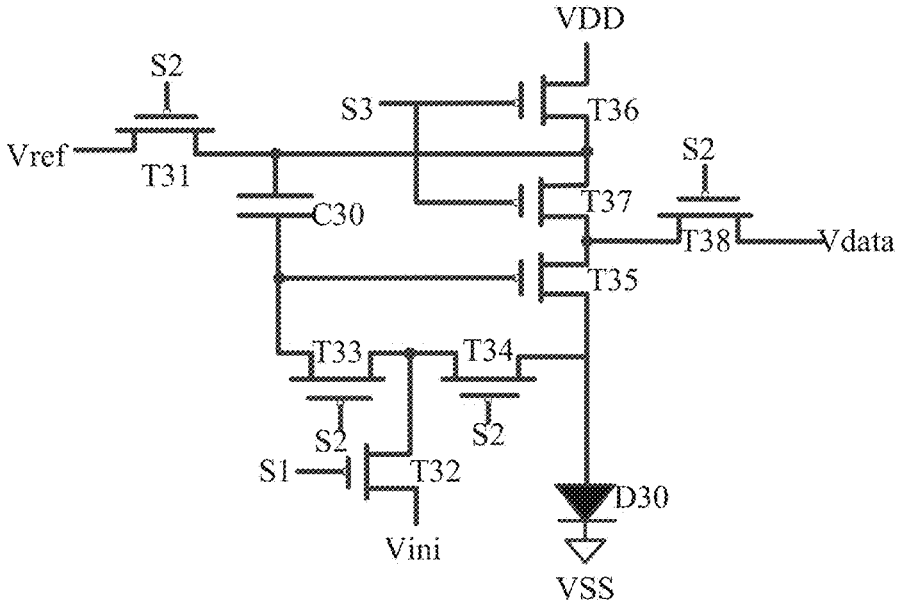
FIG. 3 is a circuit diagram of an existing 8T1C pixel driving circuit for an AMOLED.

As illustrated in FIG. 3, another existing AMOLED pixel driving circuit that uses a 8T1C structure, i.e., a structure of eight thin film transistors plus a capacitor, includes a first thin film transistor T31, a second thin film transistor T32, a third thin film transistor T33, a fourth thin film transistor T34, a fifth thin film transistor T35, a sixth thin film transistor T36, a seventh thin film transistor T37, an eighth thin film transistor T38, a capacitor C30, and an organic light emitting diode D30. Specifically, a connection manner of each of the elements is as follows. A gate of the first thin film transistor T31 receives a scan signal S2, a source of the first thin film transistor T31 receives a reference voltage Vref, and a drain of the first thin film transistor T31 is electrically coupled to a terminal of the capacitor C30 and a source of the seventh thin film transistor T37. Another terminal of the capacitor C30 is coupled to a source of the third thin film transistor T33 and a gate of the fifth thin film transistor T35. A drain of the third thin film transistor T33 is coupled to a source of the fourth thin film transistor T34 and a drain of the second thin film transistor T32, and gates of the third thin film transistor T33 and the fourth thin film transistor T34 receive the scan signal S2. A gate of the second thin film transistor T32 receives a scan signal S1, a source of the second thin film transistor T32 receives a voltage Vini.

A drain of the fourth thin film transistor T34 is coupled to a drain of the fifth thin film transistor T35 and an anode of the organic light emitting diode D30, and a cathode of the organic light emitting diode D30 receives a negative power supply voltage VSS. A source of the fifth thin film transistor T35 is coupled to a drain of the eighth thin film transistor T38 and a drain of the seventh thin film transistor T37. The source of the seventh thin film transistor T37 is coupled to a drain of the sixth thin film transistor T36, a source of the sixth thin film transistor T36 receives a positive power supply voltage VDD, and both gates of the sixth thin film transistor T36 and the seventh thin film transistor T37 receive a scan signal S3. A gate of the eighth thin film transistor T38 receives the scan signal S2, and a source of the eighth thin film transistor T38 receives a data voltage Vdata.

Although the foregoing 8T1C structure may eliminate Vth of a driving TFT, a number of TFTs used is higher, which would lower an aperture ratio of a panel, resulting in lowered displaying luminance. Moreover, the higher number of TFTs also causes problems such as parasitic capacitance. On the other hand, the structure needs additional power supplies Vref and Vini, and therefore needs more input signal sources.

Figure 4:
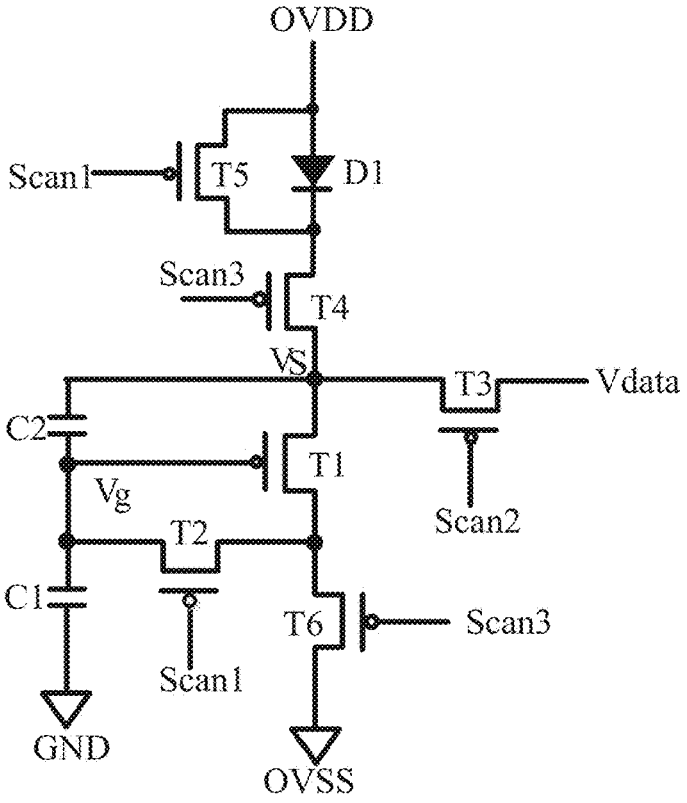
FIG. 4 is a circuit diagram of an AMOLED pixel driving circuit in accordance with the present disclosure.

Refer to FIG. 4, which is a circuit diagram of an AMOLED pixel driving circuit in accordance with the present disclosure.

As illustrated in FIG. 4, an AMOLED pixel driving circuit, in accordance with the present disclosure, includes a first thin film transistor T1, a second thin film transistor T2, a third thin film transistor T3, a fourth thin film transistor T4, a fifth thin film transistor T5, a sixth thin film transistor T6, a first capacitor C1, a second capacitor C2, and an organic light emitting diode D1. The first thin film transistor T1 is a driving thin film transistor, and the fifth thin film transistor T5 is a switch thin film transistor.

Specifically, a connection manner of each of the elements is as follows. An anode of the organic light emitting diode D1 receives a positive power supply voltage OVDD. The anode of the organic light emitting diode D1 is electrically coupled to a source of the fifth thin film transistor T5, and a cathode of the organic light emitting diode D1 is electrically coupled to a drain of the fifth thin film transistor T5 and a source of the fourth thin film transistor T4. A gate of the fifth thin film transistor T5 receives a first scan signal Scan1.

A gate of the fourth thin film transistor T4 receives a third scan signal Scan3. A drain of the fourth thin film transistor T4 is electrically coupled to a terminal of the second capacitor C2, a drain of the third thin film transistor T3, and a source of the first thin film transistor T1.

A gate of the third thin film transistor T3 receives a second scan signal Scan2, and a source of the third thin film transistor T3 receives a data voltage Vdata.

Another terminal of the second capacitor C2 is electrically coupled to a terminal of the first capacitor C1, and another terminal of the first capacitor C1 is coupled to a ground.

A gate of the first thin film transistor T1 is electrically coupled to a node between the second capacitor C2 and the first capacitor C1, and a drain of the first thin film transistor T1 is electrically coupled to a source of the second thin film transistor T2 and a drain of the sixth thin film transistor T6.

A gate of the second thin film transistor T2 receives the first scan signal Scan1, and a drain of the second thin film transistor T2 is electrically coupled to the node between the second capacitor C2 and the first capacitor C1.

A gate of the sixth thin film transistor T6 receives the third scan signal Scan3, and a source of the sixth thin film transistor T6 receives a negative power supply voltage OVSS.

The first thin film transistor T1, the second thin film transistor T2, the third thin film transistor T3, the fourth thin film transistor T4, the fifth thin film transistor T5, and the sixth thin film transistor T6 are all low-temperature polysilicon thin film transistors, oxide semiconductor thin film transistors, or amorphous silicon thin film transistors.

The first scan signal Scan1, the second scan signal Scan2, and the third scan signal Scan3 are all generated by an external timing controller.

The first thin film transistor T1, the second thin film transistor T2, the third thin film transistor T3, the fourth thin film transistor T4, the fifth thin film transistor T5, and the sixth thin film transistor T6 are all P-type thin film transistors.

The first scan signal Scan1, the second scan signal Scan2, and the third scan signal Scan3 are combined, and have timing sequences corresponding to an initialization stage, a threshold voltage storing stage, and a light emitting and displaying stage.

Based on the foregoing AMOLED pixel driving circuit, the present disclosure further provides an AMOLED pixel driving method including the following operations:

S101, providing an AMOLED pixel driving circuit.

Specifically, refer to FIG. 4 and the foregoing description.

S102, entering an initialization stage.

Figure 5:
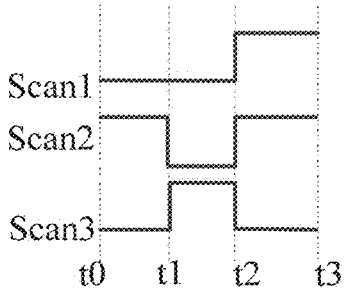
FIG. 5 is a timing diagram of the AMOLED pixel driving circuit in accordance with the present disclosure.
Figure 6:
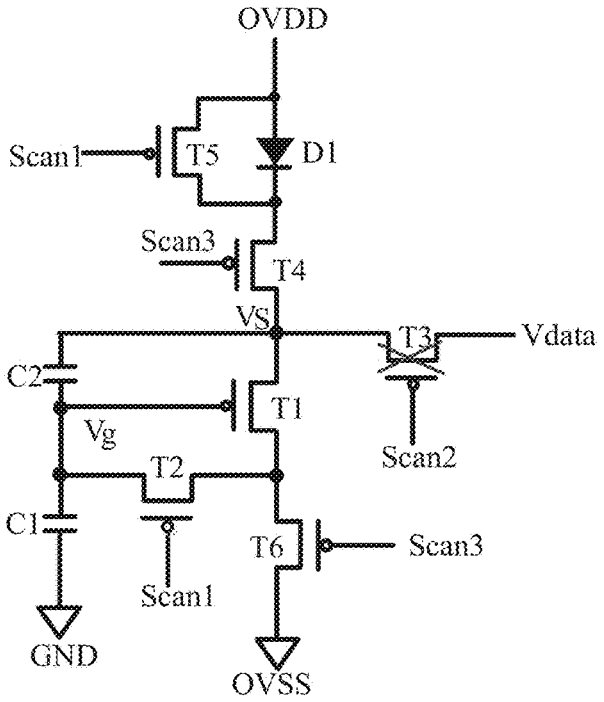
FIG. 6 is a schematic diagram an operation 2 of an AMOLED pixel driving method in accordance with the present disclosure.

Referring to FIG. 5 and FIG. 6 in combination, during the initialization stage, i.e., a t0-t1 time period, the first scan signal Scan1 and the third scan signal Scan3 are both at a low voltage level, and the second scan signal Scan2 is at a high voltage level.

The first scan signal Scan1 provides a low voltage level, and the second thin film transistor T2 and the fifth thin film transistor T5 are turned on. The second scan signal Scan2 provides a high voltage level, and the third thin film transistor T3 is turned off. The third scan signal Scan3 provides the low voltage level, and fourth thin film transistor T4 and the sixth thin film transistor T6 are turned on. Because the fifth thin film transistor T5 and the fourth thin film transistor T4 are turned on, and the third thin film transistor T3 is turned off, OVDD charges the source (an s point) of the first thin film transistor T1 through the fifth thin film transistor T5 and the fourth thin film transistor T4, resulting in a voltage Vs at the source of the first thin film transistor T1 is becoming equal to the positive power supply voltage OVDD. Because the sixth thin film transistor T6 and the second thin film transistor T2 are turned on, OVSS charges the gate (a g point) of the first thin film transistor T1 through the sixth thin film transistor T6 and the second thin film transistor T2, resulting in a voltage Vg at the gate of the first thin film transistor T1 becoming equal to the negative power supply voltage OVSS.

Because the fifth thin film transistor T5 is turned on, the organic light emitting diode D1 does not emit light. Initialization of voltage levels of the g point and the s point during this stage is completed.

S103, entering a threshold voltage storing stage.

Figure 7:
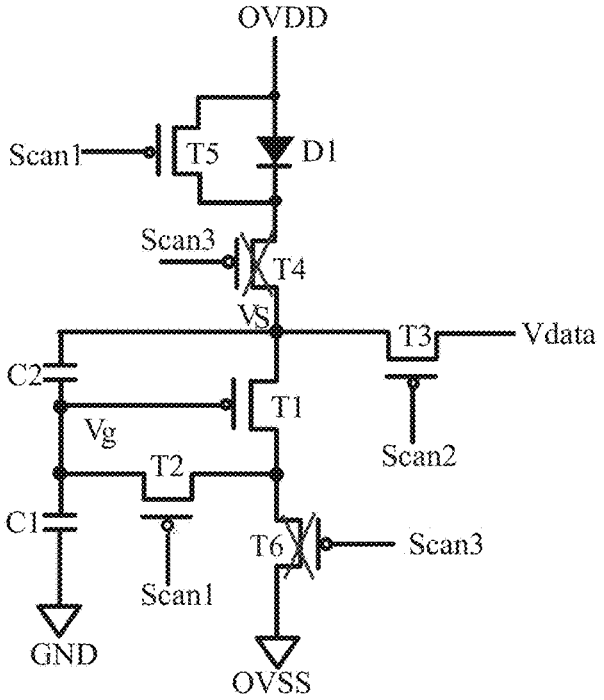
FIG. 7 is a schematic diagram an operation 3 of the AMOLED pixel driving method in accordance with the present disclosure.

Referring to FIG. 5 and FIG. 7 in combination, during the threshold voltage storing stage, i.e., a t1-t2 time period, the first scan signal Scan1 and the second scan signal Scan2 are both at the low voltage level, and the third scan signal Scan3 is at the high voltage level.

The first scan signal Scan1 provides the low voltage level, and the second thin film transistor T2 and the fifth thin film transistor T5 are turned on. The second scan signal Scan2 provides the low voltage level, and the third thin film transistor T3 is turned on; the third scan signal Scan3 provides the high voltage level, and the fourth thin film transistor T4 and the sixth thin film transistor T6 are turned off.

Because the fourth thin film transistor T4 is turned off and the third thin film transistor T3 is turned on, Vdata charges the source (the s point) of the first thin film transistor T1 through the third thin film transistor T3, resulting in a voltage level Vs at the s point is equal to the data voltage Vdata. That is, a voltage Vs at the source of the first thin film transistor T1 becomes equal to the data voltage Vdata. The sixth thin film transistor T6 is turned off, and the second thin film transistor T2 is turned on. A voltage Vg at the g point is charged through T2, T1, and T3 until a voltage across the s point and the g point is equal to the threshold voltage Vth of the driving thin film transistor (T1).

Because a difference between Vs and Vg satisfies the following equation:

$$Vs-Vg=Vth,$$

where Vs=Vdata,

Vg is expressed by $$Vg=V\text{data}-Vth.$$

That is, a voltage V at the gate of the first thin film transistor T1 is transitioned into Vdata−Vth, wherein Vdata is the data voltage, and Vth is the threshold voltage of the first thin film transistor T1.

Because the fifth thin film transistor T5 is turned on, the organic light emitting diode D1 does not emit light. Storage of the threshold voltage Vth during this stage is completed.

S104, entering a light emitting and displaying stage.

Figure 8:
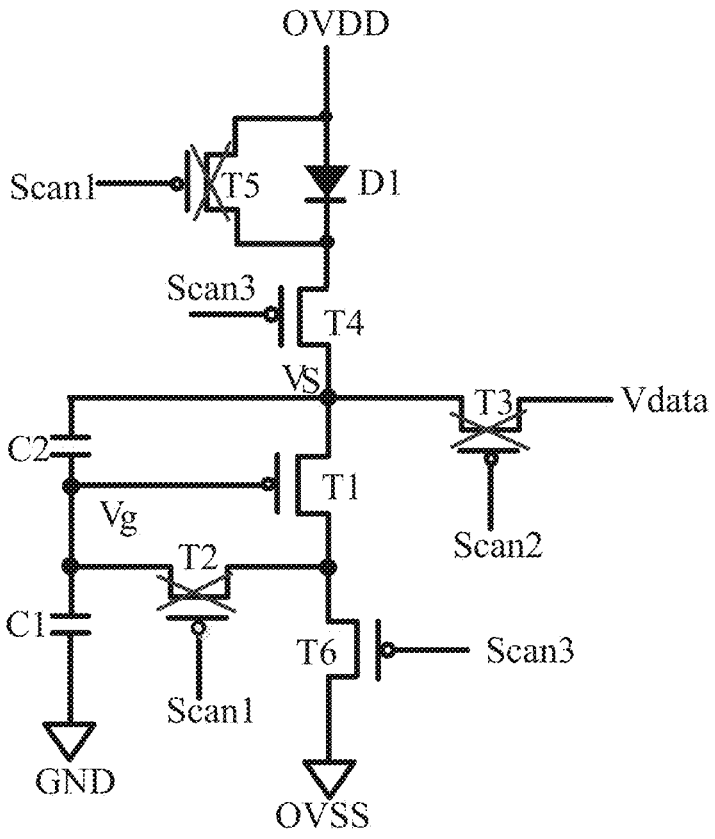
FIG. 8 is a schematic diagram an operation 4 of the AMOLED pixel driving method in accordance with the present disclosure.

Referring to FIG. 5 and FIG. 8 in combination, during the light emitting and displaying stage, i.e., a t2-t3 time period, the first scan signal Scan1 and the second scan signal Scan2 are both at the high voltage level, and the third scan signal Scan3 is at the low voltage level.

The first scan signal Scan1 provides the high voltage level, and the second scan signal Scan2 and the fifth thin film transistor T5 are turned off. The second scan signal Scan2 provides the high voltage level, and the third thin film transistor T3 is turned off. The third scan signal Scan3 provides the low voltage level, and the fourth thin film transistor T4 and the sixth thin film transistor T6 are turned on. Because the fifth thin film transistor T5 is turned off, the organic light emitting diode D1 emits light, and a current flowing through the organic light emitting diode D1 is not related to the threshold voltage Vth of the first thin film transistor T1.

Specifically, because the third thin film transistor T3 and the fifth thin film transistor T5 are turned off, and the fourth thin film transistor T4 is turned on, a voltage Vs at the s point becomes as follows:

$$Vs=OVDD-V_{OLED},$$

where $V_{OLED}$ is a voltage of the organic light emitting diode D1. That is, a voltage at the source of the first thin film transistor T1 is transitioned into a configured voltage. The configured voltage is a difference value between the positive power supply voltage OVDD and the voltage $V_{OLED}$ of the organic light emitting diode D1.

Because the second thin film transistor T2 is turned off, from a capacitive coupling theorem, a voltage Vg at the g point may be expressed as follows:

$$Vg=V\text{data}-Vth+\delta V,$$

where δV is expressed as follows:

$$\delta V=(OVDD-V_{OLED}-V\text{data})*C2/(C1+C2),$$

where δV is an effect on the voltage V at the gate of the first thin film transistor T1, wherein the effect is caused by the voltage Vs at the source of the first thin film transistor T1 after the voltage Vs at the source the first thin film transistor T1 is transitioned from the data voltage Vdata into the configured voltage, C1 is a capacitance value of the first capacitor, and C2 is a capacitance value of the second capacitor.

At this time, the voltage Vsg across the s point and the g point becomes as follows:

$$Vsg=Vs-Vg=OVDD-V_{OLED}-(V\text{data}-Vth+\delta V).$$

At this time, the current flowing through the organic light emitting diode D1 satisfies $$I=k(Vsg-Vth)^2=k(OVDD-V_{OLED}-V\text{data}-\delta V)^2.$$

Combining the aforementioned equations, the current finally flowing through the organic light emitting diode D1 is obtained and is expressed by $$I=k[(OVDD-V_{OLED}-V\text{data})*C1/(C1+C2)]^2.$$

It may be appreciated the current of the organic light emitting diode is not related to the threshold voltage Vth of the driving thin film transistor (T1), and the effect of the threshold voltage Vth on the organic light emitting diode is eliminated, thereby increasing displaying uniformity and luminous efficiency of a panel.

The AMOLED pixel driving circuit and pixel driving method improve existing pixel driving circuits in a way that eliminates the effect of the threshold voltage of the driving thin film transistor on the organic light emitting diode, thereby increasing displaying uniformity of a panel, and in addition avoiding problems such as decreased luminance and lowered luminous efficiency with aging of OLED devices of the panel.

In summary, although the present disclosure has been described with preferred embodiments thereof above, it is not intended to be limited by the foregoing preferred embodiments. Persons skilled in the art can carry out many changes and modifications to the described embodiments without departing from the scope and the spirit of the present disclosure. Therefore, the protection scope of the present disclosure is in accordance with the scope defined by the claims.

What is claimed is:

1. An active-matrix organic light-emitting diode (AMOLED) pixel driving circuit, comprising:

a first thin film transistor, a second thin film transistor, a third thin film transistor, a fourth thin film transistor, a fifth thin film transistor, a sixth thin film transistor, a first capacitor, a second capacitor, and an organic light emitting diode;

wherein an anode of the organic light emitting diode receives a positive power supply voltage; the anode of the organic light emitting diode is electrically coupled to a source of the fifth thin film transistor, and a cathode of the organic light emitting diode is electrically coupled to a drain of the fifth thin film transistor and a source of the fourth thin film transistor; and a gate of the fifth thin film transistor receives a first scan signal;

wherein a gate of the fourth thin film transistor receives a third scan signal; and a drain of the fourth thin film transistor is electrically coupled to a terminal of the second capacitor, a drain of the third thin film transistor, and a source of the first thin film transistor;

wherein a gate of the third thin film transistor receives a second scan signal, and a source of the third thin film transistor receives a data voltage;

wherein another terminal of the second capacitor is electrically coupled to a terminal of the first capacitor, and another terminal of the first capacitor is coupled to a ground;

wherein a gate of the first thin film transistor is electrically coupled to a node between the second capacitor and the first capacitor, and a drain of the first thin film transistor is electrically coupled to a source of the second thin film transistor and a drain of the sixth thin film transistor;

wherein a gate of the second thin film transistor receives the first scan signal, and a drain of the second thin film transistor is electrically coupled to the node between the second capacitor and the first capacitor;

wherein a gate of the sixth thin film transistor receives the third scan signal, and a source of the sixth thin film transistor receives a negative power supply voltage; and wherein the first thin film transistor is a driving thin film transistor, and the fifth thin film transistor is a switch thin film transistor; and the first thin film transistor, the second thin film transistor, the third thin film transistor, the fourth thin film transistor, the fifth thin film transistor, and the sixth thin film transistor are all P-type thin film transistors.

2. The AMOLED pixel driving circuit according to claim 1, wherein the first thin film transistor, the second thin film transistor, the third thin film transistor, the fourth thin film transistor, the fifth thin film transistor, and the sixth thin film transistor are all low-temperature polysilicon thin film transistors, oxide semiconductor thin film transistors, or amorphous silicon thin film transistors.

3. The AMOLED pixel driving circuit according to claim 1, wherein the first scan signal, the second scan signal, and the third scan signal are all generated by an external timing controller.

4. The AMOLED pixel driving circuit according to claim 1, wherein the first scan signal, the second scan signal, and the third scan signal are combined, and have timing sequences corresponding to an initialization stage, a threshold voltage storing stage, and a light emitting and displaying stage;

wherein during the initialization stage, the first scan signal and the third scan signal are both at a low voltage level, and the second scan signal is at a high voltage level;

wherein during the threshold voltage storing stage, the first scan signal and the second scan signal are both at the low voltage level, and the third scan signal is at the high voltage level; and wherein during the light emitting and displaying stage, the first scan signal and the second scan signal are both at the high voltage level, and the third scan signal is at the low voltage level.

5. An AMOLED pixel driving circuit, comprising:

a first thin film transistor, a second thin film transistor, a third thin film transistor, a fourth thin film transistor, a fifth thin film transistor, a sixth thin film transistor, a first capacitor, a second capacitor, and an organic light emitting diode;

wherein an anode of the organic light emitting diode receives a positive power supply voltage; the anode of the organic light emitting diode is electrically coupled to a source of the fifth thin film transistor, and a cathode of the organic light emitting diode is electrically coupled to a drain of the fifth thin film transistor and a source of the fourth thin film transistor; and a gate of the fifth thin film transistor receives a first scan signal;

wherein a gate of the fourth thin film transistor receives a third scan signal; and a drain of the fourth thin film transistor is electrically coupled to a terminal of the second capacitor, a drain of the third thin film transistor, and a source of the first thin film transistor;

wherein a gate of the third thin film transistor receives a second scan signal, and a source of the third thin film transistor receives a data voltage;

wherein another terminal of the second capacitor is electrically coupled to a terminal of the first capacitor, and another terminal of the first capacitor is coupled to a ground;

wherein a gate of the first thin film transistor is electrically coupled to a node between the second capacitor and the first capacitor, and a drain of the first thin film transistor is electrically coupled to a source of the second thin film transistor and a drain of the sixth thin film transistor;

wherein a gate of the second thin film transistor receives the first scan signal, and a drain of the second thin film transistor is electrically coupled to the node between the second capacitor and the first capacitor; and wherein a gate of the sixth thin film transistor receives the third scan signal, and a source of the sixth thin film transistor receives a negative power supply voltage.

6. The AMOLED pixel driving circuit according to claim 5, wherein the first thin film transistor, the second thin film transistor, the third thin film transistor, the fourth thin film transistor, the fifth thin film transistor, and the sixth thin film transistor are all low-temperature polysilicon thin film transistors, oxide semiconductor thin film transistors, or amorphous silicon thin film transistors.

7. The AMOLED pixel driving circuit according to claim 5, wherein the first scan signal, the second scan signal, and the third scan signal are all generated by an external timing controller.

8. The AMOLED pixel driving circuit according to claim 5, wherein the first thin film transistor, the second thin film transistor, the third thin film transistor, the fourth thin film transistor, the fifth thin film transistor, and the sixth thin film transistor are all P-type thin film transistors.

9. The AMOLED pixel driving circuit according to claim 8, wherein the first scan signal, the second scan signal, and the third scan signal are combined, and have timing sequences corresponding to an initialization stage, a threshold voltage storing stage, and a light emitting and displaying stage;

wherein during the initialization stage, the first scan signal and the third scan signal are both at a low voltage level, and the second scan signal is at a high voltage level;

wherein during the threshold voltage storing stage, the first scan signal and the second scan signal are both at the low voltage level, and the third scan signal is at the high voltage level; and wherein during the light emitting and displaying stage, the first scan signal and the second scan signal are both at the high voltage level, and the third scan signal is at the low voltage level.

10. The AMOLED pixel driving circuit according to claim 5, wherein the first thin film transistor is a driving thin film transistor, and the fifth thin film transistor is a switch thin film transistor.

11. An AMOLED pixel driving method, comprising:

providing an AMOLED pixel driving circuit;

entering an initialization stage;

entering a threshold voltage storing stage; and entering a light emitting and displaying stage;

wherein the AMOLED pixel driving circuit comprises:

a first thin film transistor, a second thin film transistor, a third thin film transistor, a fourth thin film transistor, a fifth thin film transistor, a sixth thin film transistor, a first capacitor, a second capacitor, and an organic light emitting diode;

wherein an anode of the organic light emitting diode receives a positive power supply voltage; the anode of the organic light emitting diode is electrically coupled to a source of the fifth thin film transistor, and a cathode of the organic light emitting diode is electrically coupled to a drain of the fifth thin film transistor and a source of the fourth thin film transistor; and a gate of the fifth thin film transistor receives a first scan signal;

wherein a gate of the fourth thin film transistor receives a third scan signal; and a drain of the fourth thin film transistor is electrically coupled to a terminal of the second capacitor, a drain of the third thin film transistor, and a source of the first thin film transistor;

wherein a gate of the third thin film transistor receives a second scan signal, and a source of the third thin film transistor receives a data voltage;

wherein another terminal of the second capacitor is electrically coupled to a terminal of the first capacitor, and another terminal of the first capacitor is coupled to a ground;

wherein a gate of the first thin film transistor is electrically coupled to a node between the second capacitor and the first capacitor, and a drain of the first thin film transistor is electrically coupled to a source of the second thin film transistor and a drain of the sixth thin film transistor;

wherein a gate of the second thin film transistor receives the first scan signal, and a drain of the second thin film transistor is electrically coupled to the node between the second capacitor and the first capacitor;

wherein a gate of the sixth thin film transistor receives the third scan signal, and a source of the sixth thin film transistor receives a negative power supply voltage;

wherein during the initialization stage, the first scan signal provides a low voltage level, and the second thin film transistor and the fifth thin film transistor are turned on; the second scan signal provides a high voltage level, and the third thin film transistor is turned off; the third scan signal provides the low voltage level, and fourth thin film transistor and the sixth thin film transistor are turned on; and a voltage at the source of the first thin film transistor is equal to the positive power supply voltage, and a voltage at the gate of the first thin film transistor is equal to the negative power supply voltage;

wherein during the threshold voltage storing stage, the first scan signal provides the low voltage level, and the second thin film transistor and the fifth thin film transistor are turned on; the second scan signal provides the low voltage level, and the third thin film transistor is turned on; the third scan signal provides the high voltage level, and the fourth thin film transistor and the sixth thin film transistor are turned off; a voltage at the source of the first thin film transistor is equal to the data voltage, a voltage at the gate of the first thin film transistor is transitioned into Vdata-Vth, wherein Vdata is the data voltage, and Vth is a threshold voltage of the first thin film transistor; and wherein during the light emitting and displaying stage, the first scan signal provides the high voltage level, and the second thin film transistor and the fifth thin film transistor are turned off; the second scan signal provides the high voltage level, and the third thin film transistor is turned off; the third scan signal provides the low voltage level, and the fourth thin film transistor and the sixth thin film transistor are turned on; and the organic light emitting diode emits light, and a current flowing through the organic light emitting diode is not related to the threshold voltage of the first thin film transistor.

12. The AMOLED pixel driving method according to claim 11, wherein during the light emitting and displaying stage, a voltage at the source of the first thin film transistor is transitioned into a configured voltage, wherein the configured voltage is a difference value between the positive power supply voltage and a voltage of the organic light emitting diode, and a voltage at the gate of the first thin film transistor is transitioned into Vdata-Vth+δV, so that the current flowing through the organic light emitting diode is not related to the threshold voltage of the first thin film transistor, wherein δV is an effect on the voltage at the gate of the first thin film transistor, wherein the effect is caused by the voltage at the source of the first thin film transistor after the voltage at the source the first thin film transistor is transitioned from the data voltage into the configured voltage.

13. The AMOLED pixel driving method according to claim 11, wherein the first thin film transistor, the second thin film transistor, the third thin film transistor, the fourth thin film transistor, the fifth thin film transistor, and the sixth thin film transistor are all low-temperature polysilicon thin film transistors, oxide semiconductor thin film transistors, or amorphous silicon thin film transistors.

14. The AMOLED pixel driving method according to claim 11, wherein the first scan signal, the second scan signal, and the third scan signal are all generated by an external timing controller.

15. The AMOLED pixel driving method according to claim 11, wherein the first thin film transistor is a driving thin film transistor, and the fifth thin film transistor is a switch thin film transistor.

16. The AMOLED pixel driving method according to claim 11, the first thin film transistor, the second thin film transistor, the third thin film transistor, the fourth thin film transistor, the fifth thin film transistor, and the sixth thin film transistor are all P-type thin film transistors.

* * * * *